US005797782A

United States Patent [19]

Blecker et al.

[11] Patent Number: 5,797,782

[45] Date of Patent: Aug. 25, 1998

[54] APPARATUS FOR CONNECTING A VACUUM PUMP STAND WITH AN ELECTRONIC TUBE

[75] Inventors: Armin Blecker, Asslar; Hartmut Tschesche, Braunfels, both of Germany

[73] Assignee: Balzers-Pfeiffer GmbH, Asslar, Germany

[21] Appl. No.: 622,529

[22] Filed: Mar. 25, 1996

[30] Foreign Application Priority Data

Mar. 24, 1995 [DE] Germany ..... 195 10 727.6

[51] Int. Cl.[6] ..... H01J 9/385

[52] U.S. Cl. ..... 445/70; 445/73

[58] Field of Search ..... 445/70, 73

[56] References Cited

U.S. PATENT DOCUMENTS 3,115,732 12/1963 Stewart ..... 445/73
3,345,025 10/1967 Shawfrank ..... 445/73
3,712,699 1/1973 Syster ..... 445/73
5,178,572 1/1993 Choi ..... 445/70

*Primary Examiner*—P. Austin Bradley
*Assistant Examiner*—Jeffrey T. Knapp
*Attorney, Agent, or Firm*—Anderson, Kill & Olick, P.C.

[57] ABSTRACT

An apparatus for connecting a vacuum pump stand with an electronic tube and including guide rails along which guide rolls mounted on the stand suction flange are displaced upon movement of the suction flange toward the electronic tube, and pivotal levers connected with the guide rails and supporting roller mounts of rollers for centering the electronic tube neck, with the suction flange including a gasket ring into which the electronic tube exhaust tube, which projects from the tube neck, extends in the upper end position of the suction flange, and with the guide rails having a variable profile such that the levers move, upon the upward displacement of the suction flange, from a position, in which the centering rollers are spaced from the electronic tube neck, into a position in which the centering rollers firmly engage the electronic tube neck, and then back into a position in which the centering rollers are again spaced from the electronic tube neck.

4 Claims, 3 Drawing Sheets

APPARATUS FOR CONNECTING A VACUUM PUMP STAND WITH AN ELECTRONIC TUBE

BACKGROUND OF THE INVENTION

The present invention relates to an apparatus for connecting a vacuum pump stand having a suction flange with a gasket ring with an electronic tube having a neck and an exhaust tube, which projects from the electronic tube neck and extends into the gasket ring of the suction flange upon movement of the suction flange toward the electronic tube.

Evacuation of electronic tubes is effected by using vacuum pump stands which form a component part of a completely automatized treatment system. The only action which need be performed manually, due to the existing technical level, is establishing a connection between the pump stand and the electronic tube. The connection is effected in two operational stages. In the first stage, the suction nipple of a vacuum pump is connected with the exhaust tube of the electronic tube, and in the second stage, an electrical contact for connecting the cathode of the electronic tube to a heat source is established. The existing connecting apparatuses do not permit, even if the newest robot technology is used, the automatic alignment of the exhaust tube with the suction nipple and the establishment of the electrical connection with a required precision. The required precision has up to the present been obtained only by using manual operations.

Accordingly, an object of the invention is an apparatus which would provide for an automatic connection of the exhaust tube of an electronic tube with the vacuum pump with a required precision.

Another object of the invention is providing a connecting apparatus which would also insure establishing automatically an electrical connection for heating the electronic tube cathode.

SUMMARY OF THE INVENTION

This and other objects of the invention, which will become apparent hereinafter, are achieved by providing a connecting apparatus including guide rails for guiding the suction flange upon displacement thereof toward the electronic tube neck, rollers for centering the electronic tube neck and the exhaust tube relative to the gasket ring, roller mounts for supporting the centering rollers, and pivotal levers for supporting the roller mounts and connected with the guide rails. According to the invention, the suction flange is formed as a guide table provided with guide rolls slidable along the guide rails as the suction flange moves toward the electronic tube neck, and the guide rails have a variable profile such that during an initial displacement of the suction flange toward the electronic tube neck, the levers are in a position in which the centering rollers are spaced from the electronic tube neck, that during a further displacement of the suction flange toward the electronic tube neck, the levers pivot into a position, in which the centering rollers engage the electronic tube neck and remain in this position until the exhaust tube reaches the gasket ring, and that during a still further movement of the suction flange to an end position thereof, the levers pivots back into a position in which the centering roller are again spaced from the electronic tube neck.

According to a further development of the invention, the electronic tube neck is provided with electrical contacts for connecting an electronic tube cathode with a heat source, and the suction flange includes a retaining ring supporting spring contacts for engaging the electrical contacts provided on the electronic tube neck. Release means is provided on one of the levers for displacing the retaining ring toward the electronic tube neck in the end position of the suction flange to provide for engagement of the spring contacts with the electrical contacts provided on the electronic tube neck.

The inventive apparatus enables to effect a completely automatized evacuation of electronic tubes. In particular, the apparatus insures a precise connection of an electronic tube with the vacuum pump stand during a completely automatized process, while simultaneously providing for establishing of an electrical connection for heating the cathode of the electronic tube.

BRIEF DESCRIPTION OF THE DRAWINGS

The features and objects of the present invention will become more apparent, and the invention itself will be best understood from the following detailed description of the preferred embodiment when read with reference to the accompanying drawings, wherein:

FIGS. 1*a*–3*a* show front elevational views of the apparatus for connecting a vacuum pump stand with an electronic tube at three different stages of the operational process; and FIGS. 1*b*–3*b* show top views of the apparatus shown in FIGS. 1*a*–3*a*, respectively, viewed along line A-A'

DETAILED DESCRIPTION OF THE PREFERRED EMBODIMENT

Figure 1A:
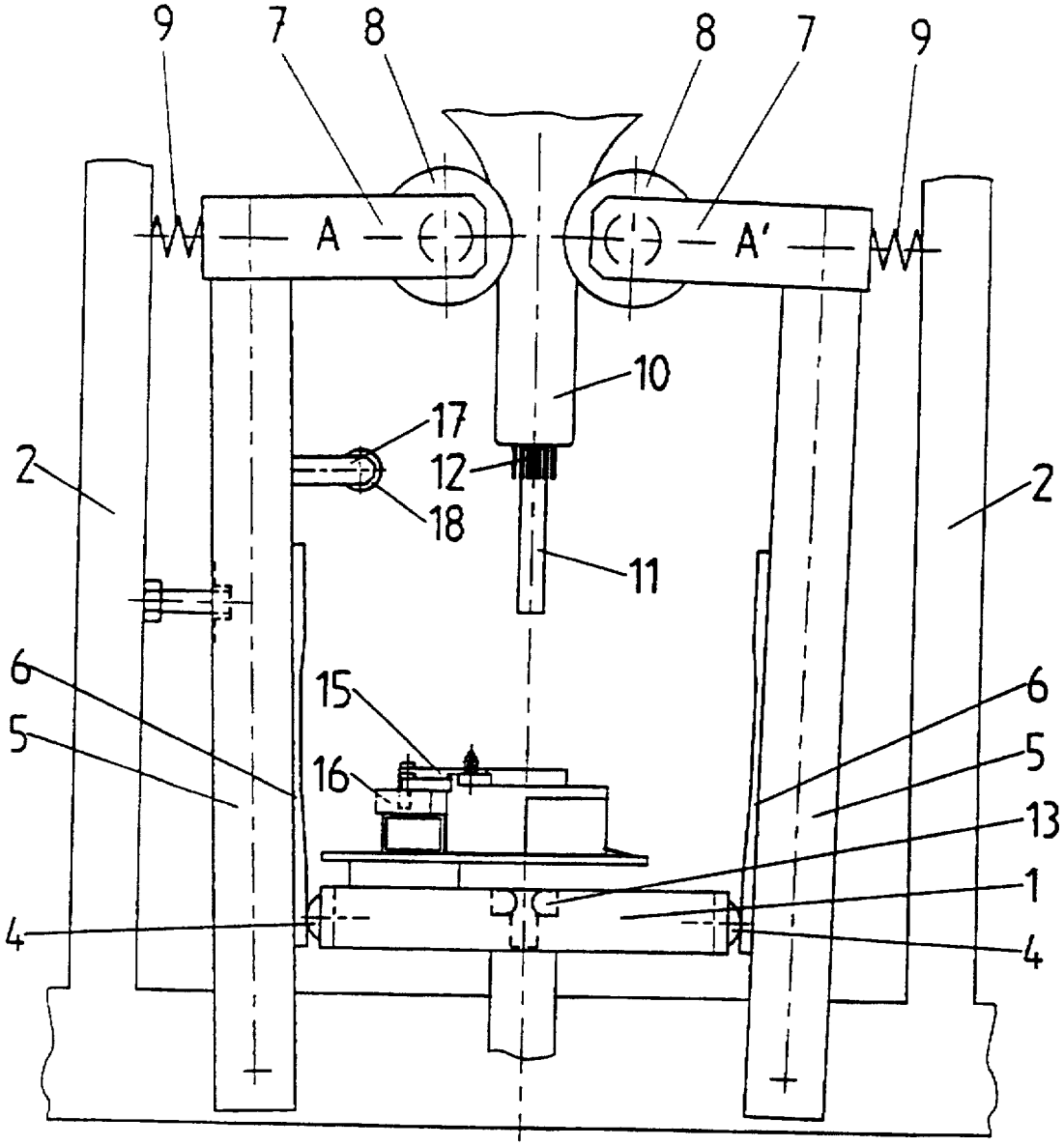

A vacuum pump stand, of which only the high vacuum side suction flange is shown in the drawings, generally serves for evacuation of an electronic tube, of which only a tube neck 10 is shown. Side guide rolls 4 are connected with the suction flange 1 which also serves as a guide table. The pump stage and, thus, elements mounted on the suction flange 1 are displaced in a direction toward the electronic tube. When the suction flange 1 moves toward the electronic tube, the guide rolls 4 slide in guide rails 6. Because the profile of the guide rails 6 changes in the flange displacement direction, pivotal levers 5, which are connected with the guide rails 6, slightly tilt in the plane of the drawing relative to an outer frame 2 under the action of springs 9 upon the displacement of the suction flange 1 in the direction toward the electronic tube. As a result, the distance between the centering rollers 8, which are connected with the levers 5 by roller mounts 7, will change. The two centering rollers 8 surround the electronic tube neck 10 so that, upon upward movement of the pump stand, the exhaust tube 11 of the electronic tube, which extends from the electronic tube neck 10, is reliably driven into a gasket ring 13 of the suction nipple.

The separate steps of the process of the connection of an electronic tube with the vacuum pump is shown in FIGS. 1*a,b*,–3*a,b*.

Figure 1B:
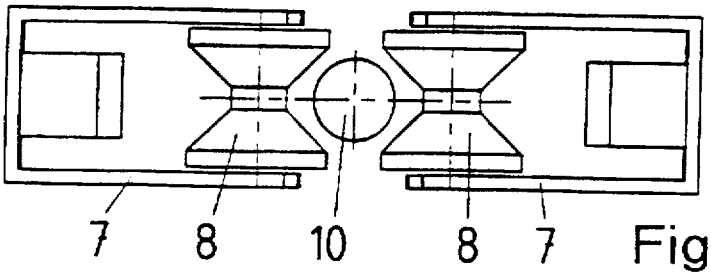
Figure 2A:
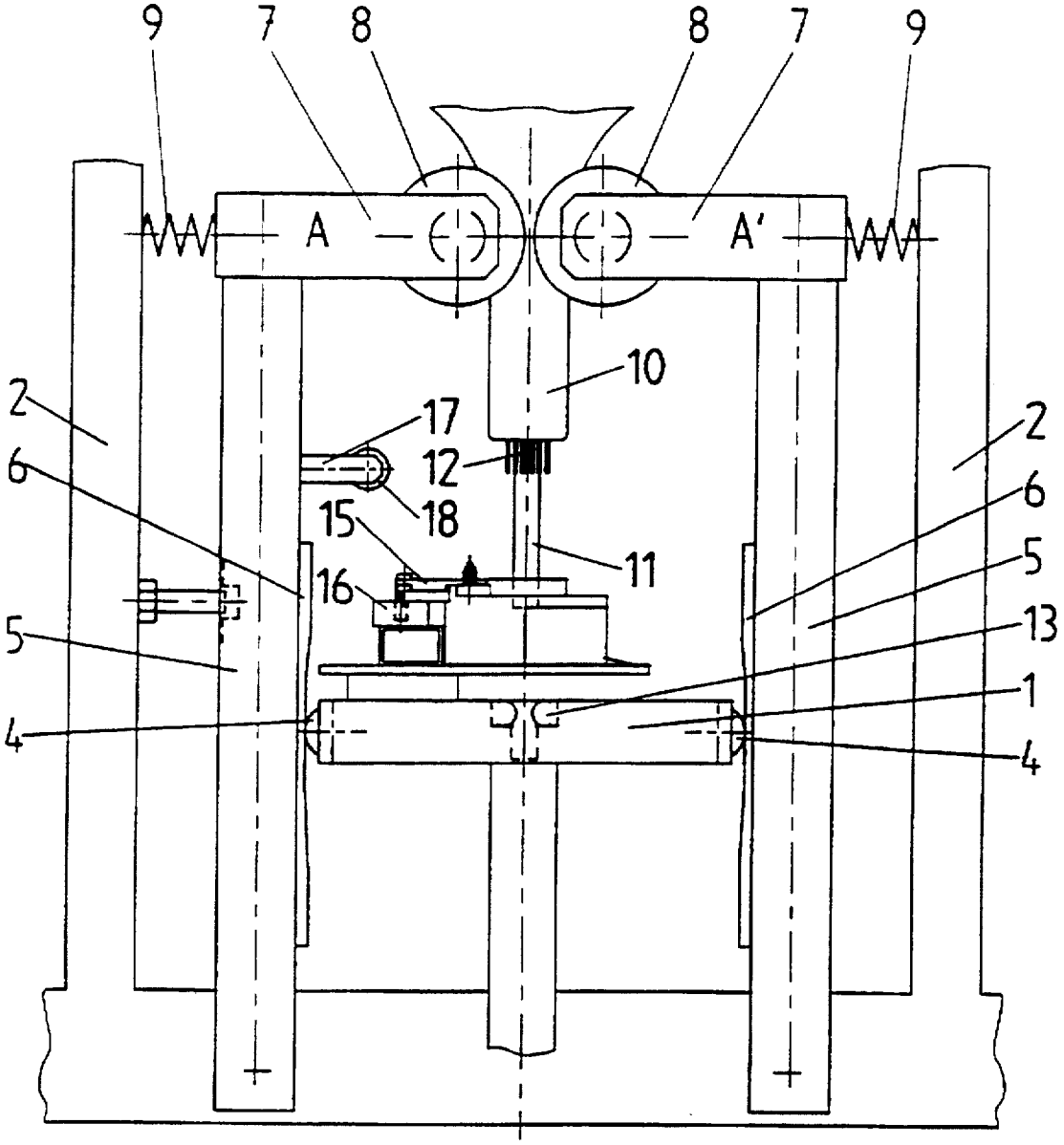
Figure 2B:
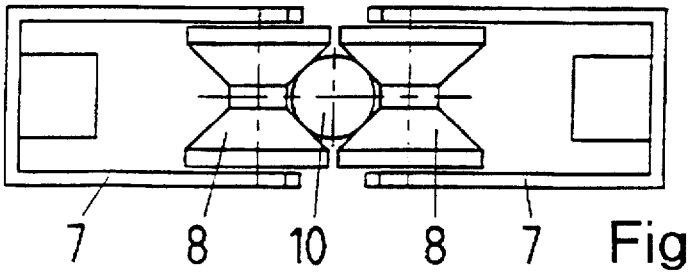
Figure 3A:
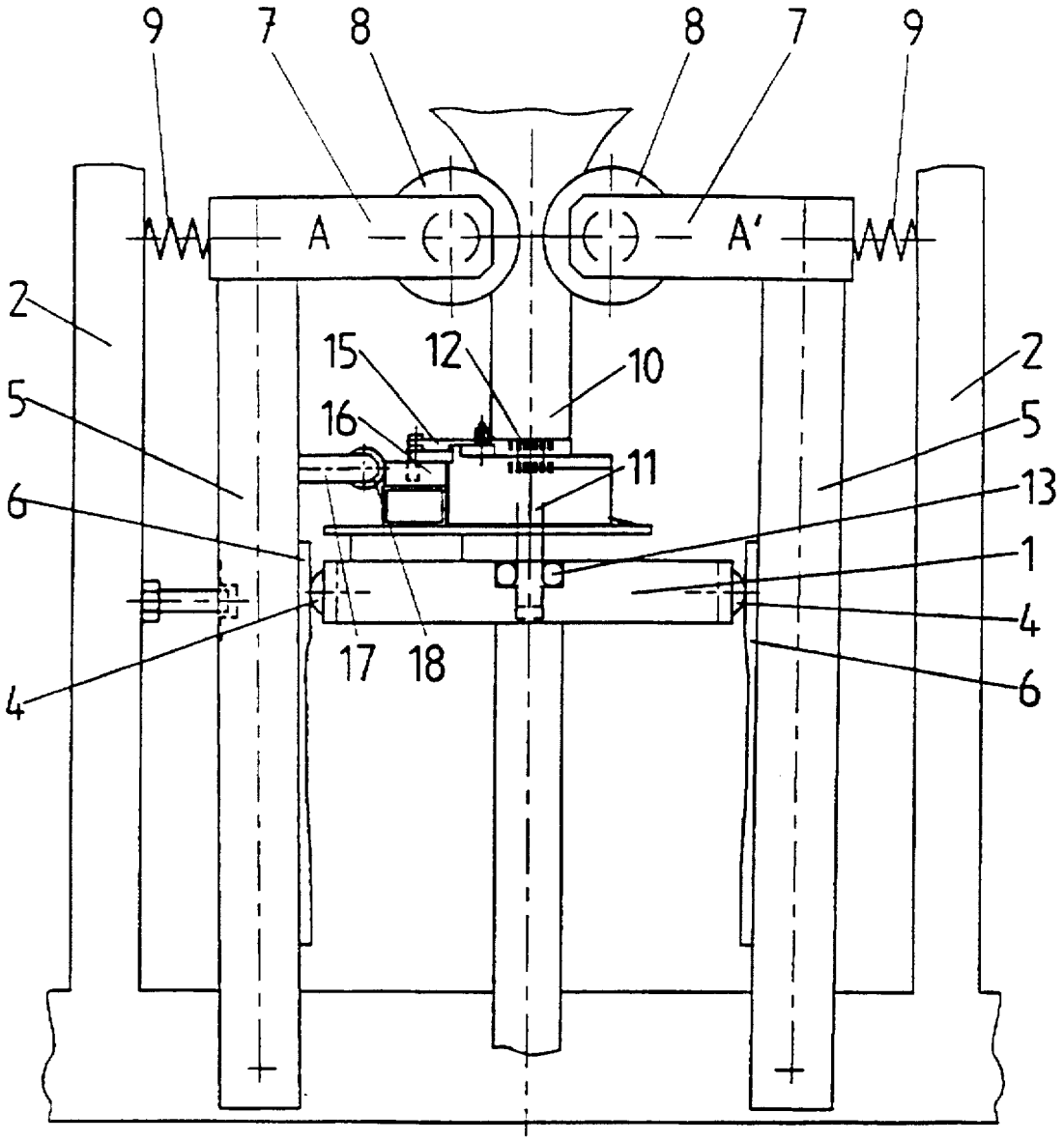
Figure 3B:
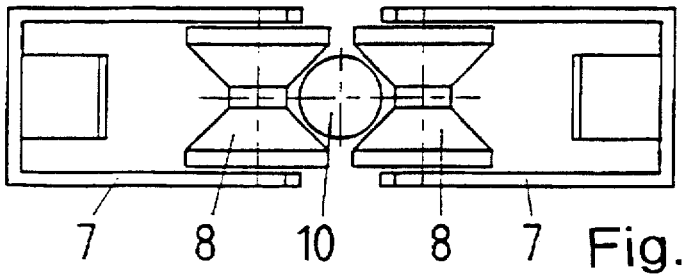

In FIG. 1*a*, the pump stand is in its lower position in which the distance between the centering rollers 8 is large, as can be seen in FIG. 1*b*. Therefore, the electronic tube neck 10 can be easily positioned between the centering rollers 8. Upon lifting of the pump stand (FIG. 2*a*), the displacement of the guide rolls 4 along the guide rails 6 causes tilting of the levers 5, which support the roller mounts 7, toward each other. As a result, the distance between the centering rollers 8 is reduced, and the centering rollers firmly engage and center the neck 10, as shown in FIG. 2*b*. Now, the exhaust tube 11 of the electronic tube can be accurately inserted in the gasket ring 13. Upon further lifting of the pump stand (FIG. 3*a*), the levers 5 tilt outwardly, due to the displacement of the guide rolls 4 along the guide rails 6. This leads to the increase in the distance between the centering rollers 8 whereby distortion of the exhaust tube is prevented.

For heating of the electronic tube cathode, the contacts 12 at the free end of the electronic tube are electrically connected to a source of heat by spring contacts 15. To insure this connection, there is provided a release element 17. A retaining ring 16 connects the spring contacts 15 with the suction flange 1, so that the spring contacts 15 are displaced, together with the suction flange 1, toward the electronic tube upon lifting of the pump stand. Upon reaching the upper end position (FIG. 3*a*), the retaining ring 16, together with the spring contacts 15, is pushed, by a roller 18 of the release element 17 toward the contacts 12 of the tube neck 10, and the spring contact 15 engage the contacts 12 of the electronic tube cathode.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. An apparatus for connecting a vacuum pump stand with an electronic tube having a tube neck with an exhaust tube projecting therefrom, with the vacuum pump stand having a suction flange including a gasket ring for receiving the exhaust tube and with the suction flange being displaceable toward the electronic tube neck, said apparatus comprising:

guide rails for guiding the suction flange upon displacement thereof toward the electronic tube neck;

rollers for centering the electronic tube neck and the exhaust tube relative to the gasket ring;

roller mounts for supporting the centering rollers; and pivotal levers for supporting the roller mounts and connected with the guide rails;

wherein the suction flange is formed as a guide table provided with guide rolls slidable along the guide rails as the suction flange moves toward the electronic tube neck, and wherein the guide rails have a variable profile such that during an initial displacement of the suction flange toward the electronic tube neck, the levers are in a position in which the centering rollers are spaced from the electronic tube neck, that during a further displacement of the suction flange toward the electronic tube neck, the levers pivot into a position, in which the centering rollers engage the electronic tube neck and remain in this position until the exhaust tube reaches the gasket ring, and that during a still further movement of the suction flange to an end position thereof, the levers pivots back into a position in which the centering rollers are again spaced from the electronic tube neck.

2. An apparatus as set forth in claim 1, further comprising springs for biasing the levers into the position in which the centering rollers engage the electronic tube neck.

3. An apparatus as set forth in claim 1, wherein the electronic tube neck is provided with electrical contacts for connecting an electronic tube cathode with a heat source, wherein the suction flange includes a retaining ring supporting spring contacts for engaging the electrical contacts provided on the electronic tube neck, and wherein a release means is provided on one of the levers for displacing the retaining ring toward the electronic tube neck in the end position of the suction flange to provide for engagement of the spring contacts with the electrical contacts provided on the electronic tube neck.

4. An apparatus as set forth in claim 3, wherein the release means comprises a displacing roller.

* * * * *